US011238801B2

(12) United States Patent
Wang

(10) Patent No.: US 11,238,801 B2
(45) Date of Patent: Feb. 1, 2022

(54) METHOD AND DEVICE FOR OBTAINING COMPENSATION PARAMETER FOR PIXEL DATA AND AMOLED DISPLAY PANEL

(71) Applicant: BOE TECHNOLOGY GROUP CO., LTD., Beijing (CN)

(72) Inventor: Yu Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/976,563

(22) PCT Filed: Dec. 24, 2019

(86) PCT No.: PCT/CN2019/127866

§ 371 (c)(1),
(2) Date: Aug. 28, 2020

(87) PCT Pub. No.: WO2020/173197

PCT Pub. Date: Sep. 3, 2020

(65) Prior Publication Data

US 2021/0225289 A1 Jul. 22, 2021

(30) Foreign Application Priority Data

Feb. 28, 2019 (CN) ..... 201910149355.X

(51) Int. Cl.
*G09G 3/3233* (2016.01)
*G09G 3/3258* (2016.01)
(Continued)

(52) U.S. Cl.
CPC ..... *G09G 3/3258* (2013.01); *G09G 3/006* (2013.01); *G09G 3/3291* (2013.01); *G09G 2320/045* (2013.01)

(58) Field of Classification Search
CPC .... G09G 3/3258; G09G 3/006; G09G 3/3291; G09G 2320/045; G09G 3/3225; G09G 3/3233; G09G 2320/0233
See application file for complete search history.

(56) References Cited

U.S. PATENT DOCUMENTS 9,099,041 B2 * 8/2015 Iida ..... G09G 3/3233
2007/0115224 A1 * 5/2007 Yamamoto ..... G09G 3/3233 345/76

(Continued)

FOREIGN PATENT DOCUMENTS

CN 205080892 U 3/2016
CN 105895027 A 8/2016

(Continued)

OTHER PUBLICATIONS

China Patent Office, First Office Action dated Mar. 23, 2020 issued in corresponding Chinese Application No. 201910149355.X.

(Continued)

*Primary Examiner* — Jose R Soto Lopez
(74) *Attorney, Agent, or Firm* — Houtteman Law LLC

(57) ABSTRACT

The present disclosure relates to a method and a device for obtaining a compensation parameter for pixel data, and an AMOLED display panel. The method for obtaining a compensation parameter for pixel data includes: obtaining a sensing voltage value of a driving transistor in each of pixel units in an AMOLED display screen in a first state; obtaining a sensing voltage value of a driving transistor in each of the pixel units in a second state; determining a compensation parameter of pixel data for each of the pixel units based on the sensing voltage values in the first state and the second state; the sensing voltage value refers to a potential value at a terminal of the driving transistor coupled with a display diode after the pixel data is written; the compensation (Continued)

parameter is used for compensating the pixel data in the subsequent display process.

20 Claims, 4 Drawing Sheets

(51) Int. Cl.
*G09G 3/00* (2006.01)
*G09G 3/3291* (2016.01)

(56) References Cited

U.S. PATENT DOCUMENTS

2007/0164959 A1* 7/2007 Childs ..... G09G 3/3291 345/92
2008/0030495 A1* 2/2008 Shirasaki ..... G09G 3/3233 345/214
2008/0106500 A1* 5/2008 Wacyk ..... G09G 3/3258 345/76
2009/0058771 A1* 3/2009 Toyomura ..... G09G 3/3233 345/80
2009/0121974 A1* 5/2009 Yamashita ..... G09G 3/3233 345/55
2009/0219231 A1* 9/2009 Yamamoto ..... G09G 3/3233 345/76
2010/0141626 A1* 6/2010 Tomida ..... G09G 3/3233 345/211
2010/0149075 A1* 6/2010 Iida ..... H01L 27/3248 345/45
2011/0063283 A1* 3/2011 Ryu ..... G09G 3/3283 345/214
2011/0096105 A1* 4/2011 Park ..... G09G 3/36 345/690
2011/0109664 A1* 5/2011 Toyomura ..... G09G 3/3225 345/690
2012/0327058 A1* 12/2012 Minami ..... G09G 3/3225 345/211
2013/0050292 A1* 2/2013 Mizukoshi ..... G09G 3/3291 345/690
2014/0176625 A1* 6/2014 Yoon ..... G09G 3/3233 345/691
2015/0077441 A1* 3/2015 Toyomura ..... G09G 3/3233 345/690
2015/0123953 A1* 5/2015 Shim ..... G09G 3/3233 345/205
2015/0154908 A1* 6/2015 Nam ..... G09G 3/3233 345/76
2015/0379937 A1* 12/2015 Kim ..... G09G 3/3291 345/691
2016/0042690 A1* 2/2016 Chang ..... G09G 3/3233 345/212
2016/0098954 A1* 4/2016 Bae ..... G09G 3/3225 345/77
2016/0247450 A1* 8/2016 Liu ..... G09G 3/3258
2016/0300528 A1* 10/2016 Kong ..... H01L 27/3265
2017/0025061 A1* 1/2017 Takizawa ..... G09G 3/3291
2018/0053462 A1* 2/2018 Bae ..... G09G 3/3233
2018/0083078 A1* 3/2018 Park ..... H01L 29/42312
2018/0268760 A1* 9/2018 Chen ..... G09G 3/3258
2018/0322830 A1* 11/2018 Xu ..... H01L 51/0031
2019/0197965 A1* 6/2019 Park ..... H01L 27/124
2020/0082759 A1* 3/2020 Lee ..... G09G 3/3291
2020/0082767 A1* 3/2020 Chen ..... G09G 3/3233
2020/0118488 A1* 4/2020 Kim ..... G09G 3/3291
2020/0143751 A1* 5/2020 Byun ..... G09G 3/3291
2020/0152123 A1* 5/2020 Kim ..... G09G 3/3233
2020/0193912 A1* 6/2020 Park ..... G09G 3/3275
2020/0234644 A1* 7/2020 Li ..... G09G 3/3258

FOREIGN PATENT DOCUMENTS

CN 107025884 A 8/2017
CN 108039146 A 5/2018
CN 108122541 A 6/2018
CN 108597449 A 9/2018
CN 108615505 A 10/2018
CN 108962111 A 12/2018
CN 109119025 A 1/2019
CN 109166529 A 1/2019
CN 109658856 A 4/2019

OTHER PUBLICATIONS

China Patent Office, Second Office Action dated Sep. 29, 2020 issued in corresponding Chinese Application No. 201910149355.X.

* cited by examiner

METHOD AND DEVICE FOR OBTAINING COMPENSATION PARAMETER FOR PIXEL DATA AND AMOLED DISPLAY PANEL

CROSS REFERENCE TO RELATED APPLICATIONS

The present application is a U.S. National Stage Application under 35 U. S. C. § 371 of International Patent Application PCT/CN2019/127866, filed on Dec. 24, 2019, which claims priority to China Patent Application No. 201910149355.X, filed on Feb. 28, 2019, the disclosure of both which are incorporated by reference herein in entirety.

TECHNICAL FIELD

The present disclosure relates to the field of display technology, and in particular to a method for obtaining a compensation parameter for pixel data, a device for obtaining a compensation parameter for pixel data, and an AMOLED display panel.

BACKGROUND

Currently, AMOLED (Active-Matrix Organic Light-Emitting Diode) display screens are increasingly widely used due to their advantages of high contrast, high color gamut, light weight, thinness, and capability of being made into flexible screens.

However, due to processes, materials, designs and the like, pixel units in the AMOLED display screen are often non-uniform, and after long-term use, threshold voltages (Vth) of driving transistors in the pixel units are easy to drift, so that a problem of poor display effect is caused, and viewing experience is reduced.

SUMMARY

The present disclosure provides a method and a device for obtaining a compensation parameter for pixel data and an AMOLED display panel, and aims to solve the problem of poor display effect caused by drift of threshold voltages of driving transistors in pixel units in the related art.

According to a first aspect of the embodiments of the present disclosure, there is provided a method for obtaining a pixel data compensation parameter, including:

obtaining a sensing voltage value of a driving transistor in each of pixel units in an AMOLED display screen in a first state;

obtaining a sensing voltage value of a driving transistor in each of the pixel units in a second state; and determining a compensation parameter of pixel data for each of the pixel units based on the sensing voltage values in the first state and the second state;

the sensing voltage value refers to a potential value at a terminal of the driving transistor coupled with a display diode after the pixel data is written into the driving transistor; the compensation parameter is used for compensating pixel data in a subsequent display process.

Optionally, the first state is a detection state when the AMOLED display screen is in a non-display process; the second state is a detection state when the AMOLED display screen is in a display process.

Optionally, the obtaining the sensing voltage value of the driving transistor in each of the pixel units in the AMOLED display screen comprises:

respectively writing fixed pixel data into the driving transistors in the pixel units;

obtaining a first sensing voltage value of each of the driving transistors when the driving transistor operates in a saturation state.

Optionally, the obtaining the sensing voltage value of the driving transistor in each of the pixel units comprises:

writing fixed pixel data into the driving transistor in each of the pixel units to obtain a second sensing voltage value of the driving transistor; and writing dynamic pixel data into the driving transistor in each of the pixel units to obtain a value of the dynamic pixel data when the sensing voltage value is equal to the first sensing voltage value.

Optionally, determining a compensation parameter of pixel data for each of the pixel units based on the sensing voltage values in the first and second states comprises:

respectively substituting the fixed pixel data and the first sensing voltage value, the fixed pixel data and the second sensing voltage value, and the dynamic pixel data and the second sensing voltage value into a current formula of the driving transistor to obtain a compensation equation set; two unknown quantities including an actual threshold voltage and a current coefficient of the driving transistor are included in the compensation equation set;

determining the actual threshold voltage and the current coefficient based on the compensation equation set, wherein the compensation parameter includes the actual threshold voltage and the current coefficient.

Optionally, the method further includes:

obtaining first pixel data of each of the pixel units corresponding to a new frame of picture; and acquiring a product of the first pixel data of each of the pixel units and the current coefficient, and a sum of the product and the actual threshold voltage, wherein the sum is a compensated pixel data.

Optionally, a control terminal of the driving transistor in each of the pixel units in the AMOLED display screen is coupled to a first switch device, the method further comprising:

turning on the first switch device to write the pixel data into the driving transistor; and controlling the driving transistor to operate in a linear state or a saturation state by controlling conduction duration of the first switch device.

Optionally, a second switch device is coupled to a connection point between the driving transistor and the display diode, the method further comprising:

turning on the second switch device to obtain the sensing voltage value of the driving transistor in each of the pixel units.

Optionally, the method further includes:

turning on the second switch device in the process of writing pixel data into a capacitor in each of the pixel units, so as to write a reset signal into a terminal of the driving transistor coupled to the display diode.

According to a second aspect of the embodiments of the present disclosure, there is provided a device for obtaining a compensation parameter for pixel data, including:

a first sensing voltage value obtaining circuit, configured to obtain a sensing voltage value of a driving transistor in each of pixel units in an AMOLED display screen in a first state;

a second sensing voltage value obtaining circuit, configured to obtain a sensing voltage value of the driving transistor in each of the pixel units in a second state, the sensing voltage value refers to a potential value at a terminal of the driving transistor couple to a display diode after pixel data is written into the driving transistor;

a compensation parameter determining circuit, configured to determine a compensation parameter of pixel data of each of the pixel units based on the sensing voltage values in the first state and the second state; the compensation parameter is configured for compensating the pixel data in a subsequent display process.

According to a third aspect of embodiments of the present disclosure, an AMOLED display panel is provided, where the display panel includes an array substrate and a driving circuit board, and the driver circuit board is configured to implement the steps of the method of the first aspect.

According to a fourth aspect of embodiments of the present disclosure, there is provided a computer readable storage medium storing computer-executable instructions which, when executed by a processor, implement the steps of the method of the first aspect.

DESCRIPTION OF DRAWINGS

The accompanying drawings, which are incorporated in and constitute a part of this specification, illustrate embodiments consistent with the present disclosure, and serve to explain principle of the present disclosure together with the description.

DESCRIPTION OF EMBODIMENTS

Figure 1:
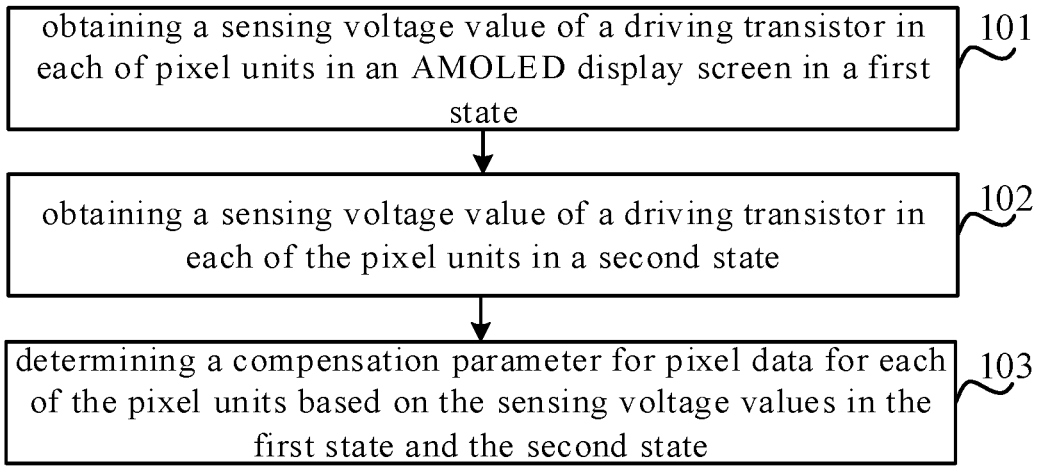
FIG. 1 is a schematic flow chart illustrating a method for obtaining a compensation parameter for pixel data according to an embodiment of the present disclosure.

Exemplary embodiments of the present disclosure will be described in detail herein, and examples of the exemplary embodiments are illustrated in the accompanying drawings. In the following description referring to the drawings, the same numbers in different drawings refer to the same or similar elements, unless otherwise indicated. The implementations described in the following exemplary examples do not represent all implementations consistent with the present disclosure, rather, they are merely examples of apparatus and methods consistent with certain aspects of the disclosure, as detailed in the appended claims.

Currently, AMOLED (Active-Matrix Organic Light-Emitting Diode) display screens are increasingly widely used due to their advantages of high contrast, high color gamut, light weight, thinness, and capability of being made into flexible screens.

However, due to processes, materials, designs and the like, pixel units in the AMOLED display screen are often non-uniform, and after long-term use, threshold voltages (Vth) of driving transistor in the pixel units are easy to drift, so that a problem of poor display effect is caused, and viewing experience is reduced.

Therefore, the present disclosure provides a method for obtaining a compensation parameter for pixel data, concept of which is in that sensing voltage values of driving transistors in pixel units of an AMOLED display screen, which are detected in at least two operation states, are obtained, and a compensation parameter can be determined based on a relationship between multiple sets of sensing voltage values and a current formula. In the subsequent display process, pixel data of each pixel unit can be adjusted by using the compensation parameter, so that an effect that display effect of all the pixel units tends to be uniform is achieved.

FIG. 1 is a schematic flow chart of the method for obtaining a compensation parameter for pixel data according to an embodiment of the present disclosure, and referring to FIG. 1, the method for obtaining a compensation parameter for pixel data may be used for a driving circuit board in an AMOLED display screen, and includes steps 101 to 103.

In step 101, a sensing voltage value of a driving transistor in each of pixel units in the AMOLED display screen in a first state is obtained.

In this embodiment, the AMOLED display screen may operate in different processes, such as a non-display process and a display process. A first state and a second state are defined in conjunction with corresponding processes when the above method is implemented, the first state is a detection state when the AMOLED display screen operates in a non-display process; the second state is a detection state when the AMOLED display screen operates in the display process.

In addition, in this embodiment, the sensing voltage value refers to a potential value at a terminal of the driving transistor coupled to a display diode after the pixel data is written into the driving transistor.

Figure 2:
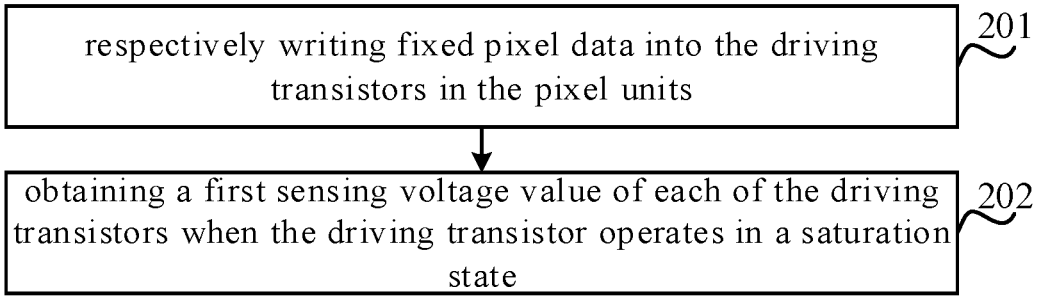
FIG. 2 is a schematic flow chart of obtaining a first sensing voltage value according to an embodiment of the present disclosure.

Referring to FIG. 2, in the present embodiment, in the first state, the driving circuit board writes fixed pixel data to the driving transistors of the pixel units respectively (corresponding to a step 201). During the continuous writing of the fixed pixel data, an operation state of the driving transistor may be switched from a linear state to a saturated state, and the sensing voltage value of the driving transistor is obtained when the driving transistor operates in the saturated state. For convenience of description, the sensing voltage value herein is defined as a first sensing voltage value (corresponding to step 202).

It should be noted that, in this embodiment, by detecting a threshold voltage of the driving transistor in the first state to obtain the sensing voltage value, a reference sensing voltage value may be provided for the subsequent detection process, i.e., in the second state, so as to improve the detection efficiency.

It can be understood that, in this embodiment, a compensation circuit of the pixel unit includes a first switch device, and the driving circuit board may control the first switch device to be turned on or turned off. The driving circuit board may further write the pixel data into the driving transistor after the first switch device is turned on. In addition, the driving circuit board may also control a conduction duration of the first switch device, so that the driving transistor can be controlled to operate in the linear state or the saturation state.

It can be understood that, in this embodiment, the compensation circuit of the pixel unit includes a second switch device, and the driving circuit board can control the second switch device to be turned on or turned off. After the second switch device is turned on, the driving circuit board may detect the sensing voltage value of the driving transistor by detecting the second switch device. In this embodiment, the driving circuit board may further turn on the second switch device, and write a reset signal to one terminal of the driving transistor coupled to the display diode through the second switch device, thereby ensuring accuracy of pixel data written into a capacitor.

In step 102, a sensing voltage value of the driving transistor in each of the pixel units in the second state is obtained.

Figure 3:
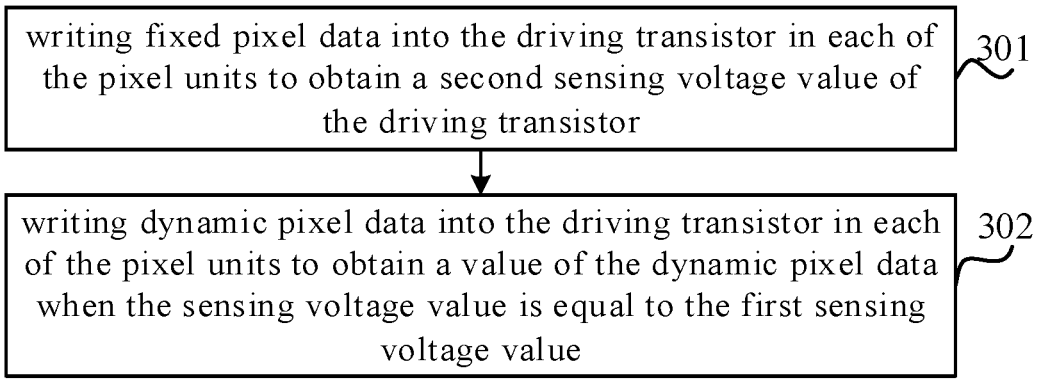
FIG. 3 is a schematic flow chart of obtaining a second sensing voltage value according to an embodiment of the present disclosure.

Referring to FIG. 3, in the second state, the driving circuit board writes fixed pixel data into the driving transistors of the pixel units, respectively, so as to obtain second sensing voltage values of the driving transistors (corresponding to step 301). It should be noted that, in step 301, the driving transistor operates in the linear state, which can be realized by adjusting the conduction duration of the first switch device T1. Then, the driving circuit board writes dynamic pixel data into the driving transistors of the pixel units to obtain the sensing voltage value which can be made to be equal to the second sensing voltage value by adjusting amplitude of the dynamic pixel data, that is, a value of the dynamic pixel data when the sensing voltage value is equal to the second sensing voltage value can be obtained (corresponding to step 302).

In step 103, compensation parameters for the pixel data of the pixel units are determined based on the sensing voltage values in the first state and the second state.

In practical applications, the driving transistor corresponds to a current formula, namely, $$I_{oled} = \frac{1}{2}\mu_n C_{ox}\frac{W}{L}(V_{GS} - V_{th})^2,$$

therefore, a linear relationship is kept between the display brightness of the display diode and a current output from the driving transistor. The meaning of each of parameters in the current formula can be referred to the related art, and is not limited herein.

Figure 4:
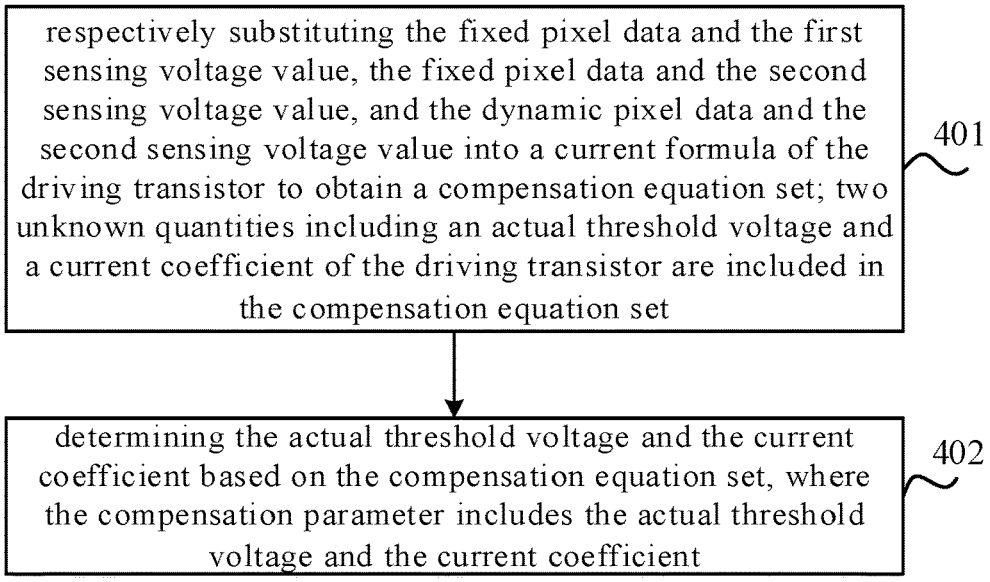
FIG. 4 is a schematic flow chart of obtaining a compensation parameter according to an embodiment of the present disclosure.

Referring to FIG. 4, based on the above current formula, the driving circuit board may substitute three sets of data, namely, fixed pixel data and a first sensing voltage value, fixed pixel data and a second sensing voltage value, and dynamic pixel data and the second sensing voltage value, into the current formula of the driving transistor, respectively, to obtain a compensation equation set including three equations (corresponding to step 401). Two unknown quantities, i.e., an actual threshold voltage and a current coefficient of the driving transistor, are included in the compensation equation set. The current coefficient is proportional to three parameters of interelectrode capacitance (Cox), coefficient (u) and width-to-length ratio (W/L) in the current formula.

With continued reference to FIG. 4, the driving circuit board may determine values of the two unknown quantities, namely, the actual threshold voltage and the current coefficient, based on the compensation equation set, where the compensation parameters include the actual threshold voltage and the current coefficient (corresponding to step 402).

Figure 5:
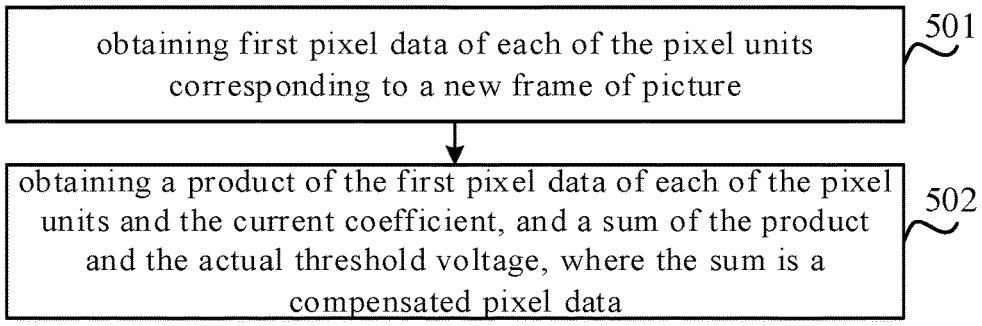
FIG. 5 is a schematic flow chart of compensating pixel data according to an embodiment of the present disclosure.

Referring to FIG. 5, in an embodiment, after the AMOLED display screen starts to display, the driving circuit board may obtain first pixel data of each of the pixel units during a new frame of picture (corresponding to step 501). Then, the driving circuit board may obtain a product of each first pixel data and the current coefficient, and a sum of the product and the actual threshold voltage, where the sum is compensated pixel data (corresponding to step 502). In this way, the driving circuit board can write the compensated pixel data into the driving transistor, and the driving transistor drives the display diode to display with a corresponding brightness.

So far, in this embodiment, sensing voltage values of the driving transistor in each of the pixel units of the AMOLED display screen in the first state and the second state are respectively obtained, then the compensation parameter of pixel data for each of the pixel units is determined based on the sensing voltage values in the first state and the second state, and pixel data for each of the pixel units may be compensated by using the compensation parameter in a subsequent display process. Therefore, threshold voltage compensation is performed on the driving transistor in each of the pixel units in the present embodiment, so that the voltage drifts of the pixel units of the display screen tend to be uniform to ensure that the pixel units have the same brightness when same pixel data is applied thereto, and the display effect and the watching experience of a user are favorably improved.

In order to achieve the implementation and advantages of the method for obtaining compensation parameter for the pixel data provided by the embodiment of the present disclosure, solutions in the embodiments are described by taking a 3T1C C compensation circuit as an example, and FIG. 1 is a circuit diagram of a 3T1C C compensation circuit.

Figure 6:
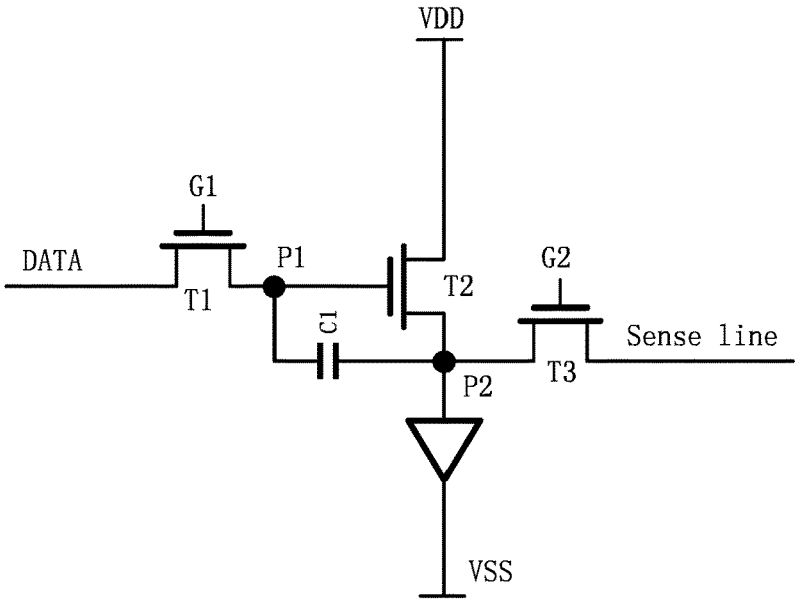
FIG. 6 is a schematic diagram of an AMOLED compensation circuit shown in an embodiment of the present disclosure.

Referring to FIG. 6, the 3T1C C compensation circuit includes a first switch device T1, a second switch device T3, a driving transistor T2, and a capacitor C1. Here, a control electrode of the driving transistor T2 is coupled to a driving circuit board (not shown) through the first switch device T1, so that the driving circuit board can write pixel data to the control electrode of the driving transistor T2. A first electrode of the driving transistor T2 is coupled to a power source terminal, a second electrode (i.e., a source electrode) is coupled to an anode of the display diode, and a cathode of the display diode is grounded; meanwhile, a second electrode of the driving transistor T2 is coupled to the driving circuit board through the second switch device T3.

In addition, the driving circuit board is also coupled to control electrodes of the first switch device T1 and the second switch device T2, and the first switch device T1 (or the second switch device T2) can be controlled to be turned on or off through controlling the control electrode thereof. For example, after the first switch device T1 is turned on, the pixel data may be written into the driving transistor T2; as another example, after the second switch device T2 is turned on, a sensing voltage value may be collected or a reset signal may be written.

Figure 7:
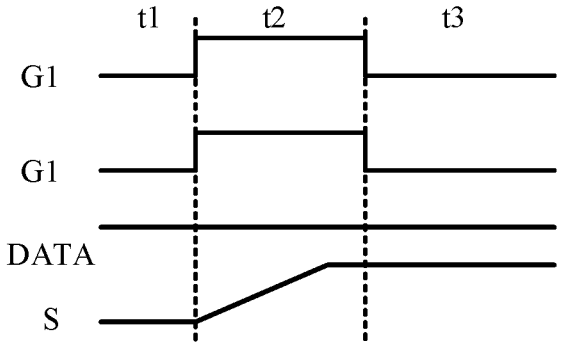
FIG. 7 is a timing sequence diagram for the AMOLED compensation circuit of FIG. 6 according to an embodiment of the present disclosure.
Figure 8:
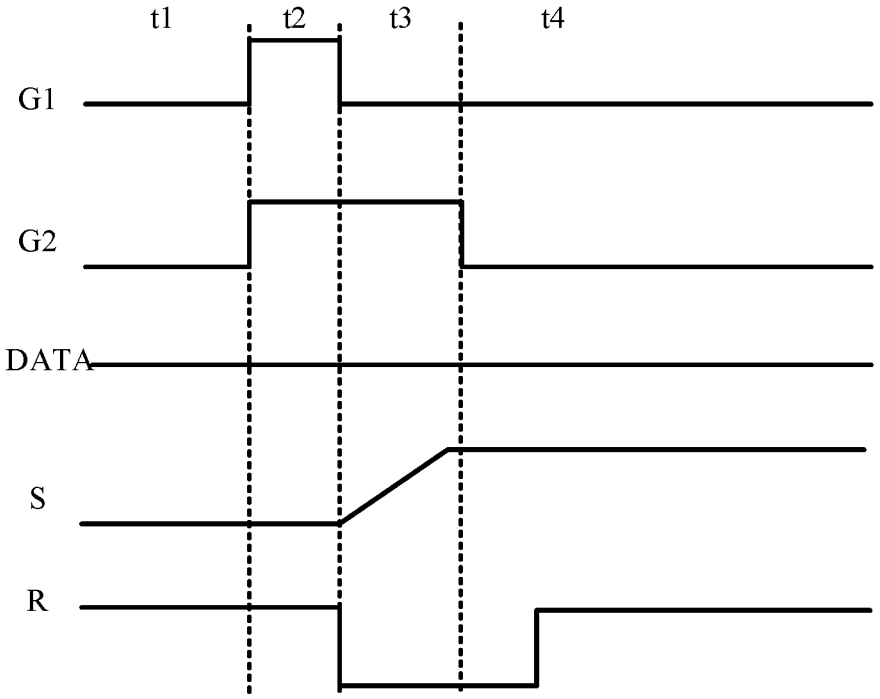
FIG. 8 is another timing sequence diagram for the AMOLED compensation circuit of FIG. 6 according to an embodiment of the present disclosure.

It should be noted that, in the embodiment of the present disclosure, two timing sequences are required to obtain the sensing voltage values of the compensation circuit shown in FIG. 6, and FIG. 7 is a timing sequence diagram for the compensation circuit shown in FIG. 6 according to an embodiment of the present disclosure; FIG. 8 is another timing sequence diagram for the compensation circuit of FIG. 6 according to an embodiment of the present disclosure. In FIGS. 7 and 8, G1 and G2 respectively represent control signals input to the control electrodes of the first switch device T1 and the second switch device T3, DATA represents the pixel data written to the driving transistor T2, S represents a voltage (i.e., a sensing voltage value) at a source electrode of the driving transistor T2, and R represents a reset signal written to the source electrode of the driving transistor T2.

Among them, the timing sequence diagram shown in FIG. 7 is used to obtain an initial threshold voltage of the driving transistor T2, the timing sequence diagram shown in FIG. 8 is used to obtain the sensing voltage value Vsense_line during the non-display process (detecting once), and obtain the sensing voltages V1 and V2 during the display process.

In the timing sequence shown in FIG. 7, the initial threshold voltage of the driving transistor T2 may be obtained and detection process is performed once. The detection process may include three stages of a stage t1, a stage t2, and a stage t3.

At the stage t1, the driving circuit board transmits low level signals to the first switch device T1 and the second switch device T3 respectively, so as to ensure that the first switch device T1 and the second switch device T3 are turned off, such that the pixel data cannot be written into the driving transistor T2, and the sensing voltage value of the driving transistor T2 cannot be detected by a sensing line (Sense line).

At the stage t2, the driving circuit board transmits high level signals to the first switch device T1 and the second switch device T3, respectively, the first switch device T1 and the second switch device T3 are turned on, and at this time, the pixel data (Vk+Vth) may be written into the driving transistor T2. During the process of writing the pixel data, the capacitor C1 is charged, a potential at a first electrode (left end in FIG. 6) of the capacitor C1 rises, and in the process of the potential at the first electrode of the capacitor C1 rising, the driving transistor T2 subjects to the following processes: first, it is turned off (the potential of the first electrode of the capacitor C1 is smaller than the threshold voltage of the driving transistor T2), then it is turned on (the potential of the first electrode of the capacitor C1 exceeds the threshold voltage of the driving transistor T2), and the degree of conduction thereof is increased more and more (the potential of the first electrode of the capacitor C1 is increased higher and higher) until the driving transistor is in a saturation state (the potential of the first electrode of the capacitor C1 exceeds a saturation voltage of the driving transistor T2), and during the process, the voltage (i.e., the sensing voltage value) detected by the detection line is also increased more and more until becomes constant, so that the initial threshold voltage V of the driving transistor can be obtained.

At the stage t3, the driving circuit board transmits low level signals to the first switch device T1 and the second switch device T3 again, so as to ensure that the first switch device T1 and the second switch device T3 are turned off, and at this time, the pixel data cannot be written into the driving transistor T2. Since charges are stored in the capacitor C1, the potential at the node P1 is Vk+Vth, and the driving transistor is still in the saturation state and turned on, so that the sensing line (Sense line) can still detect the sensing voltage value of the driving transistor T2.

In the present timing sequence shown in FIG. 8, the sensing voltage value Vsense_line during the non-display process and the sensing voltages V1 and V2 during the display process may be obtained, where each of the sensing voltage value Vsense_line, the sensing voltages V1 and V2 may be detected once, and detection thereof include four stages, i.e., a stage t1, a stage t2, a stage t3 and a stage t4.

At the stage t1, the driving circuit board transmits low level signals to the first switch device T1 and the second switch device T3 respectively, so as to ensure that the first switch device T1 and the second switch device T3 are turned off, at this time, the pixel data DATA cannot be written into the driving transistor T2, and meanwhile, the reset signal cannot be written into the source electrode of the driving transistor T2. Therefore, the sensing voltage value of the driving transistor T2 cannot be detected by the sensing line (Sense line), that is, the sensing voltage value is 0.

At the stage t2, the driving circuit board transmits high level signals to the first switch device T1 and second switch device T3, respectively, so that the first switch device T1 and second switch device T3 are turned on, and at this time, the pixel data DATA (Vk+Vth) may be written into the driving transistor T2. During writing the pixel data, the driving circuit board also writes a high-level reset signal to the source electrode of the driving transistor T2, so that a difference between voltages at the control electrode and the source electrode of the driving transistor T2 is small and insufficient to turn on the driving transistor T2.

At the stage t3, the driving circuit board transmits a low level signal and a high level signal to the first switch device T1 and the second switch device T3 respectively, so that the first switch device T1 is turned off and the second switch device T3 is turned on, at this time, the pixel data DATA (Vk+Vth) cannot be written into the driving transistor T2, and a low level reset signal can be written into the source electrode of the driving transistor T2, so that a difference between voltages at the control electrode and the source electrode of the driving transistor T2 is large, the driving transistor T2 is turned on, and the voltage at the source electrode thereof is raised.

If the stage t3 is relative short, the potential at the first electrode of the capacitor C1 can ensure that the driving transistor T2 is turned on, but is not enough to make the driving transistor T2 enter the saturation state. If the stage t3 is relative long, the potential at the first electrode of the capacitor C1 can ensure that the driving transistor T2 is turned on and enters the saturation state.

At the stage t4, the driving circuit board transmits low level signals to the first switch device T1 and the second switch device T3, respectively, to turn off the first switch device T1 and the second switch device T3, so that the sensing voltage value can be detected.

In an embodiment of the disclosure, in the first state, the AMOLED is detected once, where:

the pixel data is fixed pixel data, and at this time, the potential at the node P1 is Vk+Vth, in which case a sensing voltage value (i.e., a first sensing voltage value) Vsense_initial can be detected.

In the embodiment of the present disclosure, in the second state, the AMOLED is detected twice, where:

for detection of the first time, the pixel data is fixed pixel data, which is the same as the fixed pixel data in the first state, i.e., it is Vk+Vth, in which case a sensing voltage value (i.e., the second sensing voltage value) V1 can be detected.

for detection of the second time, the pixel data is dynamic pixel data, and by adjusting the dynamic pixel data, the sensing voltage value V2 corresponding to the dynamic pixel data may be the first sensing voltage value in the first state, and the value of the dynamic pixel data at this time is recorded.

Based on the above detection process, the pixel data and the sensing voltage value are substituted into the current formula, the following compensation equation set can be obtained:

$$V_{sense_initial}=k1*T(\text{data}1-Vth)^2$$

$$V1=k2*T(\text{data}1-Vth1)^2$$

$$V2=k2*T(\text{data}2-Vth1)^2$$

where T is time, i.e., the conduction duration of the first switch device T1; k1 and k2 are proportional to $$\frac{1}{2}\mu_n C_{ox}\frac{W}{L}.$$

Where Vsense_initial=V2, the following equation can be obtained by transformation:

$$\frac{V_{sense_initial}}{V1}=\frac{k1(\text{data}1-Vth)^2}{k2(\text{data}1-Vth1)^2}$$

$$k1(\text{data}1-Vth)^2=k2(\text{data}2-Vth1)^2$$

The above two equations include two unknown quantities, namely, an actual threshold voltage Vth1 and a compensation coefficient K2, thus the actual threshold voltage Vth1 is obtained as follows:

$$V_{th}=\frac{\text{data}2-\sqrt{\frac{V_{sense_initial}}{V_1}}\,\text{data}1}{1-\sqrt{\frac{V_{sense_initial}}{V_1}}};$$

Substituting Vth1 into the above equation can result in:

$$\frac{K2}{K1}=\frac{(\text{data}1-V_{th})^2}{(\text{data}1-\text{data}2)^2}\left(\sqrt{\frac{V_1}{V_{sense_initial}}}-1\right)^2$$

Finally, the compensated pixel data is: data1=K2*data+Vth1.

In this way, the AMOLED display screen can compensate the pixel data after each startup, and display the compensated pixel data, so that the voltage drifts of the pixel units of the display screen tend to be uniform, so as to ensure brightness of the pixel units is the same when a same pixel data is applied to the pixel units, which is helpful to improve the display effect and user's viewing experience.

Figure 9:
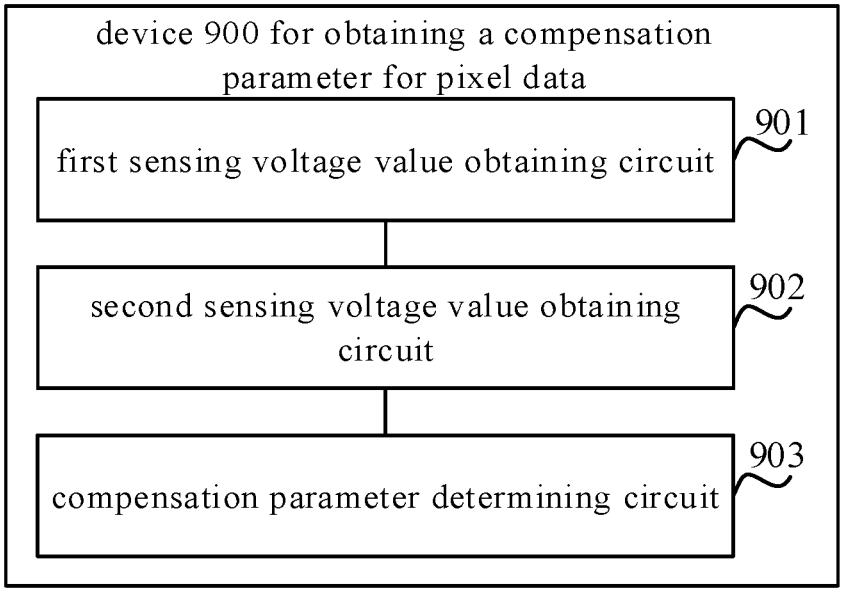
FIG. 9 is a block diagram of a device for obtaining a compensation parameter for pixel data according to an embodiment of the present disclosure.

Based on the method for obtaining the compensation parameter for the pixel data according to the embodiment of the present disclosure, the present disclosure further provides a device for obtaining a compensation parameter for pixel data. FIG. 9 is a block diagram of a device for obtaining the compensation parameter for the pixel data, as shown in FIG. 9, a device 900 for obtaining the compensation parameter for the pixel data includes:

a first sensing voltage value obtaining circuit 901, configured to obtain a sensing voltage value of a driving transistor in each of pixel units of an AMOLED display screen in the first state;

a second sensing voltage value obtaining circuit 902, configured to obtain a sensing voltage value of the driving transistor in each of the pixel units in the second state; the sensing voltage value refers to a potential value at one terminal of the driving transistor coupled to a display diode after a pixel data is written;

a compensation parameter determining circuit 903, configured to determine a compensation parameter for the pixel data of each of the pixel units based on the sensing voltage values in the first state and the second state, and the compensation parameter is used to compensate the pixel data in the subsequent display process.

Since the device for obtaining the compensation parameter for the pixel data corresponds to the method for obtaining the compensation parameter for the pixel data, the specific description of the device can refer to the content of the embodiment of the method for obtaining the compensation parameter for the pixel data, which will not be repeated here.

An embodiment of the present disclosure further provides an AMOLED display panel, where the display panel includes an array substrate and a driving circuit board, and the driving circuit board is configured to realize the steps of the method described in the embodiments shown in FIGS. 1 to 8.

An embodiment of the present disclosure further provides a computer readable storage medium, in which the computer executable instructions are stored. When the computer executable instructions are executed by a processor, the steps of the method described in the embodiments shown in FIGS. 1 to 8 are realized.

In the present disclosure, the terms "first" and "second" are used for descriptive purposes only and cannot be understood as indicating or implying relative importance. The term "multiple" refers to two or more, unless otherwise explicitly defined.

Those skilled in the art will easily conceive other embodiments of the present disclosure after considering the description and practicing the disclosure disclosed herein. The present disclosure aims to cover any variation, use or adaptability modification of the present disclosure, such any variation, use or adaptability modification follows the general principle of the present disclosure and includes common knowledge or common technical means in the technical field not disclosed by the present disclosure. The description and embodiments are only regarded as illustrative. The true scope and spirit of the present disclosure are indicated by the appended claims.

It will be understood that the disclosure is not limited to the precise arrangements that have been described above and shown in the drawings, and that various modifications and changes may be made without departing from the scope thereof. The scope of the present disclosure is limited only by the appended claims.

What is claimed is:

1. A method for obtaining a compensation parameter for pixel data, comprising:

obtaining a sensing voltage value of a driving transistor in each of pixel units in an AMOLED display screen in a first state;

obtaining a sensing voltage value of a driving transistor in each of the pixel units in a second state; and determining a compensation parameter for pixel data for each of the pixel units based on the sensing voltage values in the first state and the second state;

wherein the sensing voltage value refers to a potential value at a terminal of the driving transistor coupled with a display diode after the pixel data is written into the driving transistor; and the compensation parameter is used for compensating pixel data in a subsequent display process, wherein obtaining the sensing voltage value of the driving transistor in each of the pixel units in the AMOLED display screen comprises:

writing fixed pixel data into the driving transistors in the pixel units, respectively; and obtaining a first sensing voltage value of each of the driving transistors when the driving transistor operates in a saturation state, and wherein determining a compensation parameter for pixel data for each of the pixel units based on the sensing voltage values in the first and second states comprises:

respectively substituting the fixed pixel data and the first sensing voltage value, the fixed pixel data and the second sensing voltage value, and the dynamic pixel data and the second sensing voltage value into a current formula of the driving transistor to obtain a compensation equation set; two unknown quantities comprising an actual threshold voltage and a current coefficient of the driving transistor are included in the compensation equation set; and determining the actual threshold voltage and the current coefficient based on the compensation equation set, wherein the compensation parameter includes the actual threshold voltage and the current coefficient.

2. The method of claim 1, wherein the first state is a detection state when the AMOLED display screen is in a non-display process; the second state is a detection state when the AMOLED display screen is in a display process.

3. The method of claim 1, wherein obtaining the sensing voltage value of the driving transistor in each of the pixel units comprises:

writing fixed pixel data into the driving transistor in each of the pixel units to obtain a second sensing voltage value of the driving transistor; and writing dynamic pixel data into the driving transistor in each of the pixel units to obtain a value of the dynamic pixel data when the sensing voltage value is equal to the first sensing voltage value.

4. The method of claim 1, further comprising:

obtaining first pixel data of each of the pixel units corresponding to a new frame of picture; and obtaining a product of the first pixel data of each of the pixel units and the current coefficient, and a sum of the product and the actual threshold voltage, wherein the sum is a compensated pixel data.

5. The method of claim 1, wherein a control terminal of the driving transistor in each of the pixel units in the AMOLED display screen is coupled to a first switch device, the method further comprising:

turning on the first switch device to write the pixel data into the driving transistor; and controlling the driving transistor to operate in a linear state or a saturation state by controlling conduction duration of the first switch device.

6. The method of claim 1, wherein a second switch device is coupled to a connection point between the driving transistor and the display diode, the method further comprising:

turning on the second switch device to obtain the sensing voltage value of the driving transistor in each of the pixel units.

7. The method of claim 6, further comprising:

turning on the second switch device in the process of writing pixel data into a capacitor in each of the pixel units, so as to write a reset signal into a terminal of the driving transistor coupled to the display diode.

8. A device for obtaining a compensation parameter for pixel data, comprising:

a first sensing voltage value obtaining circuit, configured to obtain a sensing voltage value of a driving transistor in each of pixel units in an AMOLED display screen in a first state;

a second sensing voltage value obtaining circuit, configured to obtain a sensing voltage value of the driving transistor in each of the pixel units in a second state, the sensing voltage value refers to a potential value at a terminal of the driving transistor couple to a display diode after pixel data is written into the driving transistor; and a compensation parameter determining circuit, configured to determine a compensation parameter of pixel data of each of the pixel units based on the sensing voltage values in the first state and the second state; the compensation parameter is configured for compensating the pixel data in a subsequent display process, wherein the first sensing voltage value obtaining circuit is further configured to write fixed pixel data into the driving transistors in the pixel units, respectively; and obtain a first sensing voltage value of each of the driving transistors when the driving transistor operates in a saturation state, and wherein the compensation parameter determining circuit is further configured to respectively substitute the fixed pixel data and the first sensing voltage value, the fixed pixel data and the second sensing voltage value, and the dynamic pixel data and the second sensing voltage value into a current formula of the driving transistor to obtain a compensation equation set; two unknown quantities comprising an actual threshold voltage and a current coefficient of the driving transistor are included in the compensation equation set; and to determine the actual threshold voltage and the current coefficient based on the compensation equation set, wherein the compensation parameter includes the actual threshold voltage and the current coefficient.

9. An AMOLED display panel, comprising an array substrate and a driving circuit board for implementing the steps of claim 1.

10. A non-transitory computer readable storage medium storing computer-executable instructions which, when executed by a processor, implements the steps of the method of claim 1.

11. An AMOLED display panel, comprising an array substrate and a driving circuit board for implementing the steps of claim 2.

12. An AMOLED display panel, comprising an array substrate and a driving circuit board for implementing the steps of claim 1.

13. An AMOLED display panel, comprising an array substrate and a driving circuit board for implementing the steps of claim 3.

14. A non-transitory computer readable storage medium storing computer-executable instructions which, when executed by a processor, implements the steps of the method of claim 2.

15. A non-transitory computer readable storage medium storing computer-executable instructions which, when executed by a processor, implements the steps of the method of claim 3.

16. An AMOLED display panel, comprising an array substrate and a driving circuit board for implementing the steps of claim 4.

17. An AMOLED display panel, comprising an array substrate and a driving circuit board for implementing the steps of claim 5.

18. An AMOLED display panel, comprising an array substrate and a driving circuit board for implementing the steps of claim 6.

19. An AMOLED display panel, comprising an array substrate and a driving circuit board for implementing the steps of claim 7.

20. A non-transitory computer readable storage medium storing computer-executable instructions which, when executed by a processor, implements the steps of the method of claim 4.

* * * * *